United States Patent [19]

HARAI et al.

[11] Patent Number: 4,880,723

[45] **Date of Patent: * Nov. 14, 1989**

[54] PHOTOGRAPHIC SILVER HALIDE PHOTOSENSITIVE MATERIAL

[75] Inventors: Hiroyuki Harai; Yoshiharu Yabuki, both of Kanagawa, Japan

[73] Assignee: Fuji Photo Film Co., Ltd., Kanagawa, Japan

[ * ] Notice: The portion of the term of this patent subsequent to Apr. 26, 2005 has been disclaimed.

[21] Appl. No.: 14,736

[22] Filed: Feb. 13, 1987

[30] Foreign Application Priority Data

Feb. 13, 1986 [JP] Japan ..... 61-29570

[51] Int. Cl.[4] ..... G03C 1/50

[52] U.S. Cl. ..... 430/218; 430/203; 430/617; 430/619

[58] Field of Search ..... 430/608, 218, 619, 617, 430/203, 612

[56] References Cited

U.S. PATENT DOCUMENTS

| | | | |
|---|---|---|---|
| 3,260,598 | 7/1966 | Yutzy et al. | 430/206 |
| 4,585,725 | 4/1986 | Sakaguchi | 430/232 |
| 4,668,612 | 5/1987 | Hirai | 430/203 |
| 4,689,286 | 8/1987 | Schranz et al. | 430/203 |
| 4,740,445 | 4/1988 | Hirai et al. | 430/203 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A photographic silver halide photosensitive material is provided comprising a substantially water-insoluble basic metal compound and a water-soluble salt of the same metal ion as the basic metal compound which inhibits dissolution of the basic metal compound. An image is formed by combining the photosensitive material with a complexing compound in the presence of water and causing complexing reaction of the basic metal compound and the complexing compound to occur, increasing the pH of the system.

6 Claims, No Drawings

PHOTOGRAPHIC SILVER HALIDE PHOTOSENSITIVE MATERIAL

BACKGROUND OF THE INVENTION

This invention relates to a photographic silver halide photosensitive material.

Photographic processes using silver halides have been most widely used because of their improved photographic properties of sensitivity and gradation control over other photographic processes including electrophotography and diazo process. Recently developed was an advanced technique which can more conveniently and rapidly produce images by substituting a dry treatment by heating or other means for a conventional wet treatment using developing solution in processes for forming images in a photosensitive material based on silver halide.

Heat developable photosensitive materials and heat development process are well known in the art and described in the literature, inter alia, "Fundamentals of Photographic Engineering—Non-Silver Photography—", Corona Publishing K.K., Tokyo, Japan (1982), pp. 242–255; "Image Information", April 1978, pg. 40; Nebletts Handbook of Photography and Reprography, 7th ed., Van Nostrand Reinhold Company, pp. 32–33; U.S. Pat. Nos. 3,152,904, 3,301,678, 3,392,020, and 3,457,075; British Patent Nos. 1,131,108 and 1,167,777; and Research Disclosure, June 1978, pp. 9–15 (RD-17029).

A number of methods have been proposed for producing color images through heat development. Among others, U.S. Pat. Nos. 3,531,286; 3,761,270; and 4,021,240; Belgian Patent No. 802,519; and Research Disclosure, September 1975, pp. 31–32, disclose a process for forming a color image through coupling of an oxidant of a developing agent with a coupler, and a variety of developing agents used therein. Research Disclosure, May 1978, pp. 54–58, RD-16966 describes a process of forming an image by incorporating a nitrogen-containing heterocyclic group into a dye to form a silver salt and effecting heat development to release the dye.

A process for forming a positive color image by heat-sensitive silver dye bleaching process is also well known. Useful dye bleaching processes are disclosed in, for example, Research Disclosure, April 1976, pp. 30–32, RD-14433; ibid, December 1976, pp. 14-15, RD-15227; and U.S. Pat. No. 4,235,957.

A process for forming a color image using a leuco dye is described in, for example, U.S. Pat. Nos. 3,985,565 and 4,022,617.

These color image forming processes, however, have the drawback that during an extended period of storage, discoloration of color images formed and coloration of white areas occur under the action of coexisting silver halide, silver complex, developing agent and the like. New color image forming processes by heat development which are substantially free of such drawbacks are described in the following Japanese Patent Application Kokai Nos.

| | | |
|---|---|---|
| 57-179840, | 57-186774, | 57-198458, |
| 57-207250, | 58-58543, | 58-79247, |
| 58-116537, | 58-149046, | 59-48764, |
| 59-65839, | 59-71046, | 59-87450, |

-continued

| |
|---|
| 59-88730. |

These processes are designed such that a mobile dye is formed or released in proportion or counter-proportion to the reduction of photosensitive silver halide into silver by heat development, and the resultant mobile dye is transferred to a dye-fixing element.

In general, photosensitive materials are preferably developed with the pH of their reaction system maintained high. Incorporating highly alkaline compounds in photosensitive materials gives rise to storage inconvenience. Incorporating such alkaline compounds in image-receiving materials also leads to the accelerated hydrolysis of gelatin and other problems. In a system wherein water is supplied from the outside during transfer or development step, a pH changing compound may be added to the water although there arise problems of storage and handling.

Conventional wet treatments using developing solution have many problems of storage and safety because the developing solution has a high pH value.

To solve these problems, we proposed a novel image forming process in the copending application, Ser. No. 890,442 filed July 30, 1986. This image forming process involves incorporating a substantially water-insoluble basic metal compound in a photosensitive material, incorporating a complexing compound in water or an image receiving material, and causing the complexing reaction between the two compounds mediated by water to occur, thereby increasing the pH of the system. Although this process has the advantage that the image forming system can be maintained at approximately neutral pH before developing treatment and is thus easy to handle, part of the basic metal compound in the photosensitive material is dissolved to increase the pH of film somewhat higher than in conventional photosensitive material free of a basic metal compound. It is thus desirable to further improve the shelf stability of such a system.

SUMMARY OF THE INVENTION

It is an object of the present invention to provide a novel photographic silver halide photosensitive material having improved shelf stability before developing treatment and amenable to a convenient fast developing treatment.

According to the present invention, there is provided a photographic silver halide photosensitive material comprising a substantially water-insoluble basic metal compound and a water-soluble salt of the same metal ion as the basic metal compound.

DETAILED DESCRIPTION OF THE INVENTION

The photographic silver halide photosensitive material according to the present invention comprises a substantially water-insoluble basic metal compound and a water-soluble metal of the ionic metal of which the basic metal compound is made. When a compound capable of complexing reaction with the metal component in ionic form of the substantially water-insoluble basic metal compound (to be referred to as complexing compound, hereinafter) is dissolved in water and penetrated or diffused into the photosentive material, the complexing compound comes in contact with the basic metal compound whereupon the two compounds react in the presence of water to increase the pH of the image forming system to a sufficient level to initiate image forming reaction The image forming reaction system as used herein means a region where image forming reaction takes place. For example, it may be a layer on a support of a light-sensitive material or any layers belonging to light-sensitive and image-receiving elements in case both the elements are present in a photographic element. In case more than one layer is present, the system may be either one layer or all layers.

In the image forming reaction system of the present invention, water is used as a reaction medium. Water may be available by any suitable means, for example, by supplying water from without the system, or by previously incorporating water-containing capsules or similar means in the system and breaking the capsules by heating or the like to release water. Water may also be supplied as a developing solution containing at least the complexing compound and a developing agent.

The substantially water-insoluble basic metal compounds used in the present invention are those compounds having a solubility in water at 20° C. of up to 0.5 as expressed in grams of the compound dissolvable in 100 grams of water. They are represented by the general formula:

$$T_mX_n$$

wherein T is a transition metal such as Zn, Ni, Co, Fe, Mn, etc. or an alkaline earth metal such as Ca, Mg, Ba, etc.; X is a member that can form in water a counter ion to M as will be described in conjunction with the complexing compound and exhibits alkaline nature, for example, carbonate ion, phosphate ion, silicate ion, borate ion, aluminate ion, hydroxy ion, and oxygen atom; and m and n are such integers as to establish equilibrium betweeen the valences of T and X.

Some preferred, non-limiting examples of the substantially water-insoluble basic metal compounds include calcium carbonate, barium carbonate, magnesium carbonate, zinc carbonate, strontium carbonate, magnesium calcium carbonate $CaMg(CO_3)_2$;magnesium oxide, zinc oxide, tin oxide, cobalt oxide; zinc hydroxide, aluminum hydroxide, magnesium hydroxide, calcium hydroxide, antimony hydroxide, tin hydroxide, iron hydroxide, bismuth hydroxide, manganese hydroxide; calcium phosphate, magnesium phosphate; magnesium borate; calcium silicate, magnesium silicate; zinc aluminate, calcium aluminate; basic zinc carbonate $2ZnCO_3.3Zn(OH)_2.H_2O$, basic magnesium carbonate $3MgCO_3.Mg(OH)_2.3H_2O$, basic nickel carbonate $NiCO_3.2Ni(OH)_2$, basic bismuth carbonate $Bi_2(CO_3)O_2.H_2O$, basic cobalt carbonate $2CoCO_3.3Co(OH)_2$, and aluminum magnesium oxide. Most preferred among them are uncolored compounds.

It is desirable to incorporate the substantially water-insoluble basic metal compound as a fine particulate dispersion which may be prepared by the methods described in Japanese Patent Application Kokai Nos. 59-174830 and 53-102733. In such dispersions, the compounds preferably have an average particle size of 50 μm or less, especially 5 μm or less.

The amount of the substantially water-insoluble basic metal compound contained in the photosensitive material depends on the particular type and particle size of the basic metal compound used, complexing reaction rate and other factors involved. Preferably, the basic metal compound is used in an amount of up to 50% by weight based on the weight of a coating film containing the compound, and more preferably in an amount of 0.01 to 40% by weight.

The water-soluble salts of the metal ions, that is T in the above formula, of which the substantially water-insoluble basic metal compounds are made are desirably those having a solubility in water at 20° C of at least ten times that of the basic metal compounds. Preferred examples of the salts are salts of the metal ions with hydrochloric acid, sulfuric acid, nitric acid, carboxylic acids including acetic acid, oxalic acid, and formic acid, and sulfonic acids including p-toluene sulfonic acid and methane sulfonic acid.

Preferred combinations of the substantially water-insoluble basic metal compound with the water-soluble salt of the same metal ion as the basic metal compound according to the present invention are shown below, but not limited thereto.

| Basic metal compound | Water-soluble metal salt |
|---|---|
| Basic zinc carbonate | Zinc sulfate |
| Zinc hydroxide | Zinc sulfate |
| Zinc oxide | Zinc acetate |
| Calcium carbonate | Calcium chloride |
| Barium carbonate | Barium chloride |
| Aluminum hydroxide | Aluminum sulfate |

The photosensitive material of the present invention has an improved shelf life before developing treatment probably for the following reason. Provided that zinc hydroxide is added to a photosensitive material as the basic metal compound, for example, it is partially dissolved in a coated film under the action of moisture, a binder like gelatin, and various other additives to release hydroxide ions. As a consequence, the coated film increases its pH to accelerate any changes of the emulsion, dye-providing substance, reducing agent and the like in the film. When zinc sulfate is added to the coated film as the water-soluble metal salt according to the present invention, it inhibits dissolution of the zinc hydroxide to reduce the pH of the coated film, controlling any changes of the emulsion, dye-providing substance, reducing agent and the like.

The amount of the water-soluble salt of the metal ion of which the substantially water-insoluble basic metal compound is made depends on the solubility and amount of the basic metal compound added, the desired pH of the coating film, and the type of the salt itself. The preferred amount of the water-soluble metal salt added is up to an equimolar amount to the basic metal compound, more preferably up to ½ mols per mol of the basic metal compound.

The complexing compounds used in developing the photosensitive material of the present invention are those capable of forming a complex with the metal component in ionic form of the substantially water-insoluble basic metal compounds, the complex exhibiting a stability constant of at least 1 as expressed in logK.

These complexing compounds are detailed in A.E. Martell & R.M. Smith, Critical Stability Constants, Vols. 1-5, Plenum Press, inter alia.

Illustrative examples of the complexing compounds include salts of aminocarboxylic acid analogs, iminodiacetic acid analogs, anilinecarboxylic acid analogs, pyridinecarboxylic acid analogs, aminophosphoric acid analogs, carboxylic acid analogs (including mono-, di-, tri-, and tetracarboxylic acids, and their derivatives having a substituent such as phosphono, hydroxy, oxo, ester, amide, alkoxy, mercapto, alkylthio, and phosphino), hydroxamic acid analogs, polyacrylic acid analogs, and polyphosphoric acid analogs with alkali metals, guanidines, amidines, and quaternary ammonium.

Preferred, non-limiting examples of the complexing compounds are salts of picolinic acid, 2,6-pyridinedicarboxylic acid, 2,5-pyridinedicarboxylic acid, 4-dimethylaminopyridine-2,6-dicarboxylic acid, quinoline-2-carboxylic acid, 2-pyridylacetic acid, oxalic acid, citric acid, tartaric acid, isocitric acid, malic acid, gluconic acid, EDTA (ethylenediaminetetraacetic acid) , NTA (nitrilotriacetic acid), CDTA (1,2-cyclohexanediaminetetraacetic acid), hexametaphosphoric acid, tripolyphosphoric acid, tetraphosphoric acid, polyacrylic acid, and the acids of the following chemical formulae:

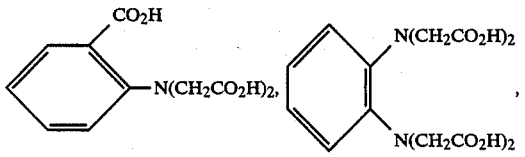

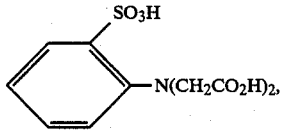

$HO_2CCH_2OCH_2CH_2OCH_2CO_2H$, $HO_2CCH_2OCH_2CO_2H$,

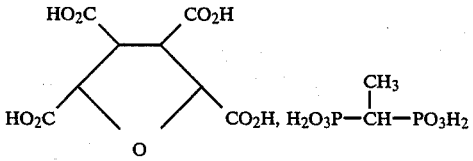

with alkali metals, quanidines, amidines, and quaternary ammonium.

Preferred among others are those aromatic heterocyclic compounds having at least one —COOM and containing one nitrogen atom on their ring wherein M is selected from alkali metals, quanidines, amidines, and quaternary ammonium ion. The ring contained therein may be a single ring or a fused ring such as pyridine ring and a quimoline ring. The position at which —COOM is attached to the ring is most preferably the α-position of the ring relative to the N atom.

Also included in the preferred compounds are those represented by the following formula:

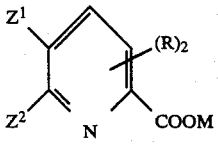

In the above formula, R represents an electron donative radical selected from hydrogen atom, aryl radicals, halogen atoms, alkoxy radicals, —COOM, hydroxycarbonyl radical, amino and substituted amino radicals, and alkyl radicals. The two R's may be the same or different. $Z^1$ and $Z^2$ are as defined for R and may be combined together to form a ring fused to the pyridine ring. M is as defined above.

Examples of the most preferred combinations of the substantially water-insoluble metal compounds and the complexing compounds are illustrated below. In the following formulae, $M^{\oplus}$ represents an alkali metal ion, substituted or unsubstituted quanidinium ion, amidinium ion, or quaternary ammonium ion.

| Difficultly soluble compound | Complexing compound |
|---|---|
| Calcium carbonate | 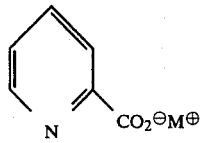 |
| Basic zinc carbonate | 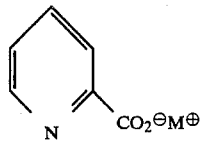 |
| Basic magnesium carbonate | 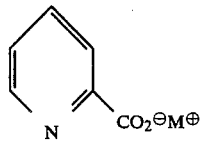 |
| Zinc oxide | 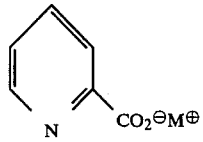 |
| Basic zinc carbonate | 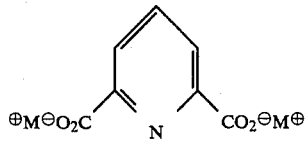 |
| Basic magnesium carbonate | 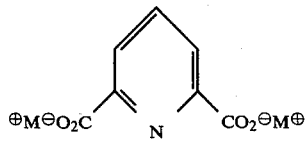 |
| Calcium carbonate | 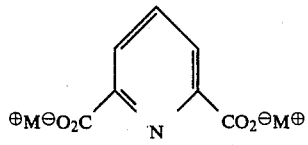 |
| Zinc oxide | 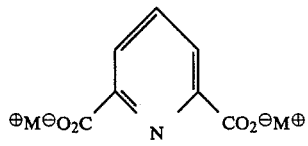 |
| Calcium carbonate | $\oplus M^{\ominus}O_2C.CO_2^{\ominus}M^{\oplus}$ |

-continued

| Difficultly soluble compound | Complexing compound |
|---|---|
| Calcium carbonate | 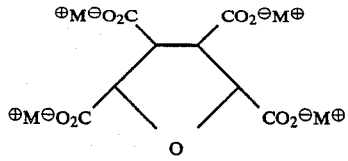 |
| Barium carbonate | $^{\oplus}M^{\ominus}OOC-COO^{\ominus}M^{\oplus}$ |
| Calcium carbonate | $M^{\oplus}$ salt of tripolyphosphoric acid |
| Calcium carbonate | $M^{\oplus}$ salt of citric acid |
| Calcium carbonate | $M^{\oplus}$ salt of polyacrylic acid |
| Calcium carbonate | 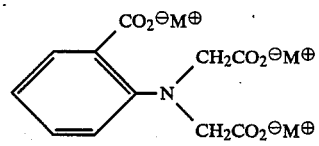 |
| Magnesium oxide | 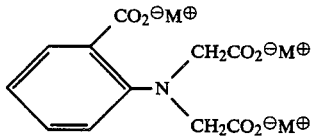 |
| Zinc hydroxide | 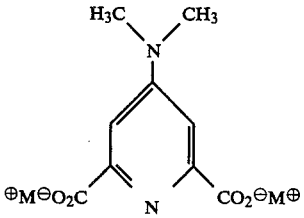 |
| Tin hydroxide | 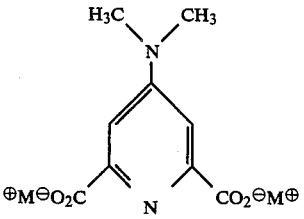 |
| Magnesium hydroxide | $M^{\oplus}$ salt of hexametaphosphoric acid |
| Calcium carbonate | 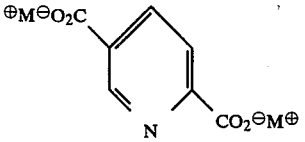 |
| Basic magnesium carbonate | $^{\oplus}M^{\ominus}OOC-COO^{\ominus}M^{\oplus}$ |
| Calcium carbonate | 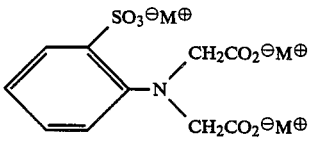 |

-continued

| Difficultly soluble compound | Complexing compound |
|---|---|
| Basic zinc carbonate | 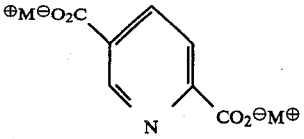 |

These combinations may be used alone or in admixture of two or more. They may be used along with any well-known bases or base precursors.

The mechanism of increasing the pH of the reaction system according to the present invention will be described by referring to one exemplary combination of potassium picolinate with zinc hydroxide. Their reaction may be represented by the following scheme:

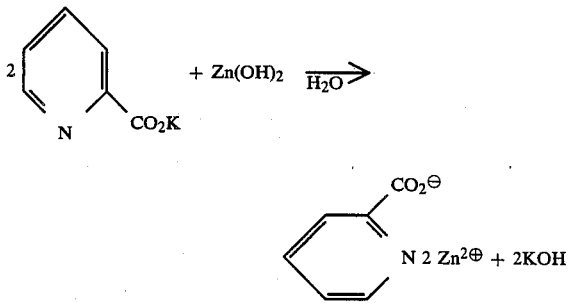

When potassium picolinate and zinc hydroxide are mediated by water, picolinate ions make a complexing reaction with zinc ions and the reaction proceeds according to the above-illustrated scheme, exhibiting a high alkalinity.

The progress of this reaction is attributable to the stability of the resulting complexes. Picolinate ions ($L^{\ominus}$) and zinc ions ($M^{\oplus}$) form complexes ML, $ML_2$, and $ML_3$ having a very high stability constant as shown below, which well accounts for the progress of the reaction.

| | ML | $ML_2$ | $ML_3$ |
|---|---|---|---|
| logK | 5.30 | 9.62 | 12.92 |

For the developing treatment of the photosensitive material of the present invention containing the substantially water-insoluble basic metal compound and the water-soluble metal salt inhibitor, it is desirable that the complexing compound involved be contained in an image-receiving material Also, the complexing compound may be supplied as being dissolved in water or developing solution The silver halides used in the present invention include silver chloride, silver bromide, silver chlorobromide, silver chloroiodide, silver iodobromide, and silver chloroiodobromide, but not limited thereto.

Useful are silver halide emulsions as disclosed in, inter alia, U.S. Pat. No. 4,500,626, col. 50; Research Disclosure, June 1978, pp. 9–10 (RD 17029); and Japanese Patent Application Nos. 59-228551, pp. 35–36, which are all incorporated herein by reference.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The silver halide emulsions used in the practice of the present invention may be either of the surface latent image type wherein latent images are predominantly formed on the grain surface or of the internal latent image type wherein latent images are formed in the grain interior. Also employable is a direct reversal emulsion having an internal latent image type emulsion combined with a nucleating agent.

The amount of the photosensitive silver halide coated preferably ranges from 1 mg to 10 g of silver per square meter.

In the practice of the present invention, an organic metal salt may be used as an oxidizing agent in combination with the photosensitive silver halide. It is necessary that the photosensitive silver halide and the organic metal salt be in contact with or close to each other. Preferred organic metal salts are organic silver salts.

The organic compounds which can be used in the preparation of the organic silver salt oxidizing agents include those compounds disclosed in Japanese Patent Application No. 59-228551, pp. 37–39 and U.S. Pat. No. 4,500,626. Also useful are silver salts of carboxylic acids having an alkynyl radical such as silver phenylpropiolate as disclosed in Japanese Patent Application No. 58-221535.

These organic silver salts may be used in amounts of from 0.01 to 10 mols, preferably from 0.01 to 1 mol per mol of the photosensitive silver halide. The combined amount of the photosensitive silver halide and the organic silver salt coated suitably ranges from about 50 $mg/m^2$ to 10 $g/m^2$ calculated as silver.

The silver halides used in the practice of the present invention may be spectrally sensitized with methine dyes and other dyes. The dyes useful for spectral sensitization include cyanine dyes, merocyanine dyes, complex cyanine dyes, complex merocyanine dyes, holopolar cyanine dyes, hemiyanine dyes, styryl dyes, and hemioxonol dyes. Illustrative examples are the sensitizing dyes disclosed in Japanese Patent Application Kokai Nos. 59-180550 and 60-140335 and Research Disclosure, June 1978, pp. 12–13 (RD 17029); and the sensitizing dyes of heat-decoloring nature disclosed in Japanese Patent Application Kokai No. 60-111239 and Japanese Patent Application No. 60-172967. These sensitizing dyes may be used individually or as a combination thereof. A combination of sensitizing dyes is frequently used for supersensitization.

In addition to the sensitizing dye, the emulsion may contain a dye which itself has no spectral sensitization function or a material which does not substantially absorb visible light, but is capable of supersensitization. Such supersensitizing compounds are disclosed in the following U.S. Pat. Nos.:

| | | |
|---|---|---|
| 2,933,390 | 3,635,721 | 3,635,721 |
| 3,743,510 | 3,615,613 | 3,615,641 |

-continued

| | |
|---|---|
| 3,617,295 | 3,635,721. |

These sensitizing dyes may be added to the emulsion during, before or after chemical ripening, or before or after nucleation of silver halide grains according to the teachings of U.S. Pat. Nos. 4,183,756 and 4,225,666. The amount of the sensitizing dye is generally from $10^{-8}$ to $10^{-2}$ mol per mol of the silver halide.

In the practice of the present invention, silver may be used as an image-forming material. Also, there may be contained a compound which, when the photosensitive silver halide or silver ion is reduced into silver at elevated temperatures, produces or releases a mobile or diffusible dye in direct or inverse proportion to the reaction. These compounds are simply referred to as dye-providing substances hereinfter.

Typical of the dye-providing substances which can be used in the present invention are couplers capable of reaction with developing agents. In the system using a coupler, a silver salt and a developing agent make a redox reaction to form an oxidant of the developing agent which in turn, reacts with the coupler to form a dye. Illustrative examples of the developing agents and couplers are described in detail in, for example, T.H. James, "The Theory of the Photographic Process", 4th Ed., pp. 291–334 and 354–361, and the following laid-open specifications.

| | | |
|---|---|---|
| 58-123533 | 58-149046 | 58-149047 |
| 59-111148 | 59-124399 | 59-174835 |
| 59-231539 | 59-231540 | 60-2950 |
| 60-2951 | 60-14242 | 60-23474 |
| 60-66249. | | |

The dye-providing substances employable other than the aforementioned include dye-silver compounds in which an organic silver salt is combined with a dye. Examples of the dye-silver compounds are described in Research Disclosure, May 1978, pp. 54-58 (RD-16966). Also included are azo dyes useful in heat development silver dye bleaching process. Examples of the azo dyes and bleaching process are described in U.S. Pat. No. 4,235,957 and Research Disclosure, April 1976, pp. 30–32 (RD-14433). A further example of the dye-providing substance is leuco dyes as described in U.S. Pat. Nos. 3,985,565 and 4,022,617.

Another class of dye-providing substances includes compounds having the function of releasing or diffusing a diffusible dye imagewise. The compounds of this type may be represented by the following formula [L I]:

$$(\text{Dye-X})_n\text{-Y}$$

wherein Dye represents a dye group, a temporarily wavelength shortened dye group or a dye precursor group; X represents a single bond or a connecting linkage; and Y represents a group which, in correspondence or counter-correspondence to photosensitive silver salt having a latent image distributed imagewise, produces a difference in diffusibility of the compound represented by $(\text{Dye-X})_n$-Y or releases Dye, the diffusibility of Dye released being different from that of the compound represented by $(\text{Dye-X})_n$-Y; and n represents an integer of 1 or 2, when n=2, the Dye-X's may be the same or different. More specifically, X is $-SO_2-$ or a group which can be split off from Y by the coupling reaction of Y with an oxidant of a developing agent. The splittable groups represented by Y are described in U.S. Pat. Nos. 4,483,914 and 4,474,867.

Exemplary of the dye-providing substances having general formula [L I]there may be given dye developing reagents in the form of a hydroquinone-type developing reagent having a dye moiety attached thereto as disclosed in U.S. Pat. Nos. 3,134,764; 3,362,819; 3,597,200; 3,544,545; and 3,482,972. In addition, substances which release a diffusible dye through intramolecular nucleophilic substitution reaction are disclosed in U.S. Pat. No. 3,980,479, and substances which releases a diffusible dye through intramolecular rewind reaction of an isooxazolone ring are disclosed in Japanese Patent Application Kokai No. 49-111628. In the systems to which these substances are applied, a diffusible dye is released or diffused where no development has taken place and no dye is released or diffused where development has taken place.

Another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible dye. Typical examples of the dye-providing substances usable in such a system are described in Japanese Patent Application Kokai Nos. 53-110827, 54-130927, 56-164342, and 53-35533.

Also known are substances which release a diffusible dye where development has occurred. Couplers having a diffusible dye as an eliminatable group and thus releasing a diffusible dye through reaction with an oxidant of a developing reagent, known as DDR couplers, are described in British Patent No. 1,330,524; Japanese Patent Publication No. 48-39165; U.S. Pat. No. 3,443,940 and the like.

The systems using these reducing agents have the serious problem that the resulting image can be contaminated with oxidation decomposition products of a reducing agent. To overcome this problem, dye-releasing (DRR) compounds have been proposed which themselves have reducing nature without the need for a reducing agent. Advantageous results are obtained particularly when such reducing dye-releasing compounds are combined with the heat-developable photosensitive materials of the present invention. Typical examples of these compounds are dye-providing substances described in the following publications:

| | | |
|---|---|---|
| U.S. Pat. Nos. | 3,725,062, | 3,728,113, |
| 3,443,939, | 3,928,312, | 4,053,312, |
| 4,055,428, | 4,336,322, | 4,500,626. |
| Japanese Patent Application Kokai Nos. | | |
| 59-65839, | 59-69839, | 58-116537, |
| 57-179840, | 53-3819, | 51-104343 |
| Research Disclosure, RD 17465. | | |

Representative examples of these dye-providing substances are those compounds described in the aboveincorporated U.S. Pat. No. 4,500,626, cols. 22–44, most preferably the compounds identified therein as compounds (1)–(3), (10)–(13), (16)–(19), (28)–(30), (33)–(35), (38)–(40), and (42)–(64). Also useful are the compounds described in Japanese Patent Application Kokai No. 61-124941.

In the practice of the present invention, the dye-providing substances and other hydrophobic additives such as image formation accelerators as will be described later may be introduced into a layer of photosensitive material by any well-known methods, for example, the method described in U.S. Pat. No. 2,322,027. In this case, an organic solvent having a high boiling point as described in Japanese Patent Application Kokai Nos. 59-83154, 59-178451, 59-178452, 59-178453, 59-178454, 59-178455, and 59-178457 may be used, optionally in admixture with an organic solvent having a low boiling point in the range of from 50° C. to 160° C. The amount of the high boiling organic solvent used in the present invention is up to 10 grams, preferably up to 5 grams per gram of the dye-providing substance.

Further, it is possible to use a method for dispersion in polymers as described in Japanese Patent Publication No. 51-39853 and Japanese Patent Application Kokai No. 51-59943.

In case the substance is substantially insoluble in water, it may be finely divided into particles before being incorporated in the binder although the aforementioned methods may also be applicable. Moreover, various surface-active agents may be used when a hydrophobic substance like the dye-providing substance is dispersed in a hydrophilic colloid. For this purpose, the surface-active agents illustrated by Japanese Patent Application Kokai No. 59-15735, incorporated herein by reference, pp. 37–38 may be used.

A reducing agent may desirably be used in the photosensitive material in the practice of the present invention. The reducing agents used herein include well-known reducing agents and the above-mentioned dye-providing substances having reducing ability. Also included are reducing agent precursors which themselves have no reducing nature, but exhibit reducing nature under the action of a nucleophilic agent or heat during the development process.

Examples of the reducing agents used herein include those reducing agents described in U.S. Pat. No. 4,500,626, cols. 49–50, U.S. Pat. No. 4,483,914, cols. 30–31, Japanese Patent Application Kokai No. 60-140335, pp. 17–18, and Japanese Patent Application Kokai Nos. 60-128438, 60-128436, 60-128439, and 60-128437. Also useful are reducing agent precursors as disclosed in Japanese Patent Application Kokai Nos. 56-138736 and 57-40245, U.S. Pat. No. 4,330,617, and the like. Various combinations of reducing agents as described in U.S. Pat. No. 3,039,869 may also be used.

In the practice of the present invention, the reducing agent may be added in amounts of from 0.01 to 20 mols, preferably from 0.1 to 10 mols per mol of silver.

An image formation promotor may also be used in the photosensitive material in the practice of the present invention. The image formation promotors have the functions of promoting such reaction as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, high-boiling organic solvents (oils), thermal solvents, surface-active agents, and compounds capable of interacting with silver or silver ion. It should be noted that these compounds generally have multiple functions and thus possess some of the above-mentioned promoting effects combined.

For further detail, reference is to be made to Japanese Patent Application No. 59-213978, pp. 67–71.

In the practice of the present invention, a variety of development inhibitors may be used for the purpose of obtaining a consistent image irrespective of variations in treating temperature and time during development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds and their precursors, and the like. Specific examples are disclosed in Japanese Patent Application Nos. 58-216928, 59-48305, 59-85834, and 59-85836.

Also useful are those compounds which release mercapto compounds upon heating, for example, those described in the following Japanese Patent Applications.

| | | |
|---|---|---|
| 59-190173 | 59-268926 | 59-246468 |
| 60-26038 | 60-22602 | 60-26039 |
| 60-24665 | 60-29892 | 59-176350 |

Further, in the present invention, it is possible to use a compound which activates development simultaneously with stabilizing the image. Particularly preferred compounds used herein are those described in U.S. Pat. No. 4,500,626, cols. 51–52.

A variety of anti-fogging agents may be used in the practice of the present invention. Preferred anti-fogging agents are azoles and azaindenes as disclosed in Research Disclosure, December 1978, pp. 24–25, nitrogen-containing carboxylic acids and phosphoric acids as described in Japanese Patent Application Kokai No. 59-168442, mercapto compounds and metals salts thereof as described in Japanese Patent Application Kokai No. 59-111636, and acetylene compounds as described in Japanese Patent Application No. 60-228267.

The photosensitive material used in the practice of the present invention may contain a toning agent if desired. Useful toning agents are those described in Japanese Patent Application No. 59-268926, pp. 92–93.

The binders employed in the photosensitive material in the practice of the present invention may be hydrophilic. The typical hydrophilic binder is a transparent or translucent hydrophilic binder, examples of which include natural substances, for example, proteins such as gelatin, gelatin derivatives and cellulose derivatives and polysaccharides such as starch, gum arabic, etc.; and synthetic polymers, for example, water-soluble polyvinyl compounds such as polyvinyl pyrrolidone, acrylamide polymer, etc. Another example of the synthetic polymer compound is a dispersed vinyl compound in a latex form which is used for the purpose of increasing the dimensional stability of a photographic material. These binders may be used alone or in admixture. The binders may be coated in amounts of up to 20 grams per square meter, preferably up to 10 grams per square meter, and most preferably up to 7 grams per square meter.

The high-boiling organic solvent may be dispersed in the binder together with hydrophobic compounds, for example, a dye-providing substance such that the volume of the solvent is less than about 1 cc, preferably less than about 0.5 cc, and most preferably less than about 0.3 cc per gram of the binder.

Any of the layers of the photographic photosensitive material and optionally combined dye-fixing material according to the present invention, including photographic emulsion, binder and other layers, may contain inorganic or organic hardeners. Illustrative examples of the hardeners are those set forth in Japanese Patent Application No. 59-268926, pp. 94–95, and Japanese Patent Application Kokai No. 59-157636, p. 38. They may be used alone or in combination.

The support suitable or use in the photosensitive material and optional dye-fixing material according to the present invention must withstand the processing temperature. Exemplary of ordinary supports there may be given not only glass, paper, polymer film, metal and analogues, but also those described as supports in Japanese Patent Application No. 59-268926, pp. 95–96.

Where the photosensitive material of the present invention contain a colored dye-providing substance, it is not necessarily required for the photosensitive material to further contain an anti-irradiation or anti-halation agent or dye. If desired, a filter dye or absorbing material may be contained as described in Japanese Patent Application No. 59-268926, pp. 97–98 and U.S. Pat. No. 4,500,626, col. 55, lines 41–52.

In order to provide a wide range of color within the chromaticity diagram using the three primary colors, yellow, magenta and cyan, the photosensitive elements used in the present invention should include at least three silver halide emulsion layers having sensitivity in different spectra. Combinations of three layers, typically blue-, green-, and red-sensitive layers, and green-, red-, and infrared-sensitive layers are contemplated herein. Typical combinations of at least three photosensitive silver halide emulsion layers having sensitivity in different spectra are described in Japanese Patent Application Kokai 59-180550. One photosensitive emulsion layer having sensitivity in a certain spectrum may be divided into two or more sublayers, depending on the sensitivity of emulsion, if desired.

The photosensitive materials used in the practice of the present invention may further contain any of various additives well known for use in heat-developable photo-sensitive elements and possess in addition to the photo-sensitive layers, any layers including a protective layer, intermediate layer, antistatic layer, electroconductive layer, antihalation (AH) layer, release layer for facilitating separation from a dye-fixing element, and matte agent layer.

Exemplary of the additives there may be given plasticizers, matte agents, sharpness improving dyes, antihalation (AH) dyes, sensitizing dyes, surface-active agents, brighteners, UV absorbers, anti-sliding agents, antioxidants, anti-discoloration agents, etc. as described in Research Disclosure, Vol. 170, June 1978, No. 17029, and Japanese Patent Application No. 59-209563. More specifically, the protective layer or coat (PC) usually contains an organic or inorganic matte agent for adherence prevention. The protective layer may futher contain a mordant, a UV absorber, etc. Each of the protective and intermediate layers may be comprised of two or more layers.

The intermediate layer may contain a reducing agent for preventing discoloration or color mixing, a UV absorber, and a white pigment such as titanium dioxide. The white pigment may be added not only to the intermediate layer, but also to the emulsion layers for the purpose of increasing sensitivity.

The photographic element according to the present invention may be comprised of a photosensitive element which forms or releases a dye through heat development and optionally, a dye-fixing element which fixes the dye.

Particularly, systems of forming an image through diffusion transfer of a dye need the photosensitive and dye-fixing elements as requisite elements. They are generally classified into two typical forms, one form having photosensitive and dye-fixing layers separately applied on two separate supports and another form having both photosensitive and dye-fixing layers applied on a common support. With respect to the relation of the photosensitive element and the dye-fixing element to one another, to the support, and to a white reflective layer, reference may be made to the descriptions of Japanese Patent Application No. 59-268926, pp. 58–59 and U.S. Pat. No. 4,500,626, col. 57.

A typical system having both photosensitive and dye-fixing elements applied on a common support is one wherein the photosensitive element need not be peeled from the image-receiving element after formation of a transfer image. In this case, a photosensitive layer, a dye-fixing layer, and a white reflective layer are laminated on a transparent or opaque support. The preferred arrangements are transparent support/photosensitive layer/white reflective layer/dye-fixing layer and transparent support/dye-fixing layer/white reflective layer/photosensitive layer, to name a few.

Another typical form having both photosensitive and dye-fixing elements applied on a common support is one wherein a release layer is applied at a proper location such that the photosensitive element may be entirely or partially separated from the dye-fixing element, as disclosed in Japanese Patent Application Kokai No. 56-67840, Canadian Patent No. 674,082, and U.S. Pat. No. 3,730,718.

The photosensitive element and/or dye-fixing element according to the present invention may have an electro-conductive heating element layer serving as heating means for heat development or diffusion transfer of dye. Such a transparent or opaque heating element may be provided in the form of a resistance heating element using a conventional well-known technique. The resistance heating element may be prepared by utilizing a thin film of a semiconductive inorganic material or an organic thin film of conductive fine particles dispersed in a binder. The materials which can be used in these methods are described in Japanese Patent Application No. 59-151815.

The dye-fixing element preferably used in the present invention has at least one layer containing a mordant. Where the dye-fixing layer is positioned at the surface, a protective layer may be provided thereon if necessary. The dye-fixing element, particularly with respect to its layer arrangement, binder, additives, and location of a mordant-countaining layer, is described in Japanese Patent Application No. 59-268926, pp. 62–63 and the patent specifications cited therein, which are incorporated herein by reference.

The dye-fixing element may optionally be provided with any auxiliary layers, for example, a release layer, matte agent layer, and anti-curling layer, in addition to the above-mentioned layers. One or more of these layers may contain a base and/or base precursor for promoting dye transfer, hydrophilic thermal solvent, plasticizer, anti-discoloration agent, UV absorber, anti-sliding agent, matte agent, antioxidant, dispersed vinyl compound for increasing dimensional stability, surface-active agent, brightener, etc. Illustrative examples of these additives are described in Research Disclosure, Vol. 170, June 1978 (RD 17029) and Japanese Patent Application No. 59-209563, pp. 101–120.

The binders in the above-mentioned layers are preferably hydrophilic, and a typical binder is a transparent or translucent hydrophilic colloid Illustrative examples are those previously enumerated for the photosensitive material.

The image-receiving layer used in the present invention is a dye-fixing layer which is commonly used in a heat-developable color photosensitive material and contains a mordant selected from commonly used ones. Preferred mordants are polymeric mordants. The polymeric mordants include polymers containing a tertiary amino group, polymers having a nitrogen-containing heterocyclic moiety, and polymers containing a quaternary cationic group. Examples are described in Japanese Patent Application No. 59-268926, pp. 98–100 and U.S. Pat. No. 4,500,626, cols. 57–60.

In the practice of the present invention, the heat-developable photosensitive, protective, intermediate, undercoat, backcoat, dye-fixing, and other layers may be applied by any conventional coating methods, typically, the method described in U.S. Pat. No. 4,500,626, cols. 55–56.

The light source for image exposure to record an image in the heat-developable light-sensitive element may be any radiation including visible light. In general, light sources used in ordinary color printing may be used as set forth in Japanese Patent Application No. 59-268926, p. 100 and U.S. Pat. No. 4,500,626, col. 56.

The heating temperature used in the heat development step generally ranges from about 50° C. to about 250° C., preferably from about 80° C. to about 180° C. Where a dye transfer step is carried out after completion of a heat development step, the heating temperature used in the transfer step may range from room temperature to the temperature used in the heat development to enable dye transfer, more preferably from 50° C. to a temperature which is about 10° C. lower than the temperature used in the heat development. Heating means used in the development and/or transfer step include heat blocks, irons, heat rollers, and heating elements using carbon and titanium white, but not limited thereto.

It is also useful that a heat-developable photo-sensitive material is heated in the presence of a minor amount of solvent, typically water to concurrently or sequentially conduct development and transfer as described in Japanese Patent Application Kokai No. 59-218443 and Japanese Patent Application No. 60-79709. In this image forming process, the above-mentioned image formation promotor may be previously contained in the dye-fixing material and/or photosensitive material. The process of concurrently or sequentially carrying out development and transfer prefers a heating temperature in the range from 50° C. up to the boiling point of the solvent, for example, from 50° C. to 100° C. for water solvent.

A solvent may also be used in order to enable the mobile dye to migrate to the dye-fixing layer.

Examples of the solvents used to provide for promotion of development and/or migration of a mobile dye to the dye-fixing layer are water and aqueous basic solutions containing inorganic alkali metal salts and organic bases, with the bases being selected from those previously described in conjunction with the image formation promotor. Also useful are low-boiling solvents and mixtures of low-boiling solvents and water or aqueous basic solutions. Such additives as surface-active agent, anti-fogging agent, and difficultly soluble metal salt-complexing agent combination may be contained in the solvent.

These solvents may be applied to the dye-fixing material and/or photosensitive material. The amount of solvent used is as small as up to the weight of solvent corresponding to the maximum swollen volume of the overall coatings, more specifically up to the weight of solvent corresponding to the maximum swollen volume of the overall coatings minus the weight of the overall coatings.

The solvent, typically water is applied between a photosensitive layer of a heat-developable photosensitive material and a dye-fixing layer of a dye-fixing material in order to promote formation of an image and/or migration of a dye, and it may be incorporated in either the photosensitive and/or dye-fixing layer. A suitable method for providing the solvent to the photosensitive or dye-fixing layer is described in Japanese Patent Application No. 59-268926, pp. 101–102, for example.

To promote dye transfer, the photosensitive material or dye-fixing material may contain therein a hydrophilic thermal solvent which is solid at an ambient temperature, but melts at elevated temperatures to serve as solvents. The hydrophilic thermal solvent may be incorporated in the photosensitive element and/or the dye-fixing element. Although the solvent can be incorporated into any of the emulsion layer, intermediate layer, protective layer, and dye-fixing layer, it is preferred to incorporate it into the dye-fixing layer and/or layers adjacent thereto. Examples of the hydrophilic thermal solvents include ureas, pyridines, amides, sulfonamides, imides, alcohols, oximes and other heterocyclic compounds.

Heating means used during the transfer step in the practice of the present invention may be any of the means described in Japanese Patent Application No. 59-268926, pp. 102–103. It is also possible to provide the dye-fixing material with a layer of electroconductive material such as graphite, carbon black, and metal whereby electric current is conducted to the conductive layer to directly heat the material.

The pressure under which the photosensitive and dye-fixing materials are placed in firm contact and application of such pressure may be in accord with the method described in Japanese Patent Application No. 59-268926, pp. 103–104.

BENEFITS OF THE INVENTION

According to the present invention, the inclusion of a substantially water-insoluble basic metal compound and a water-soluble salt of the same metal ion as the basic metal compound provides a photographic silver halide photosensitive material which has an improved shelf stability prior to developing treatment and is briefly and rapidly developable.

EXAMPLES

In order that those skilled in the art may better understand how the present invention may be practiced, the following examples are given by way of illustration and not by way of limitation.

Example 1

Preparation of Silver Halide Emulsions

A silver halide emulsion used in a first layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.35 μm (bromine 80 mol %).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a third layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide, another aqueous solution of 0.59 mols of silver nitrate in 600 ml of water, and a dye solution containing 160 mg of dye (I) as shown below in 400 ml of methanol were concurrently added to the gelatin solution at an equal flow rate over a period of 40 minutes. In this way, there was prepared a monodispersed cubic silver chlorobromide emulsion having an average grain size of 0.35 μm (bromine 80 mol %).

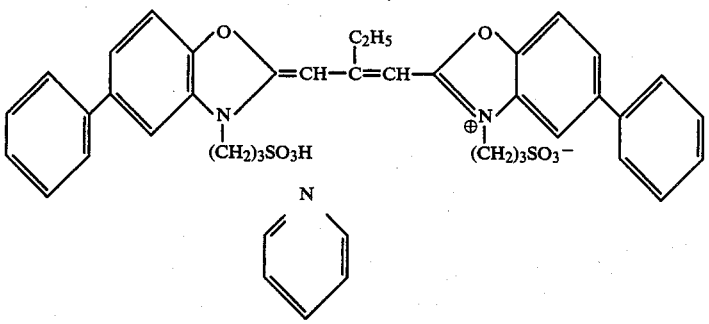

After water rinsing and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a fifth layer was prepared as follows.

An aqueous gelatin solution was prepared by dissolving 20 grams of gelatin and ammonia in 1000 ml of water and kept at a temperature of 50° C. While fully agitating the gelatin solution, 1000 ml of an aqueous solution of potassium iodide and potassium bromide and another aqueous solution of 1 mol of silver nitrate in 1000 ml of water were concurrently added to the gelatin solution, the pAg of which was kept constant. In this way, there was prepared a monodispersed octahedral silver iodobromide emulsion having an average grain size of 0.5 μm (iodine 5 mol %).

After rinsing with water and desalting, 5 mg of chloroauric acid tetrahydrate and 2 mg of sodium thiosulfate were added to effect gold and sulfur sensitization at 60° C. There was obtained an emulsion in a yield of 1000 grams.

Organic silver salts were prepared as follows.

Organic silver salt (1)

A silver benzotriazole emulsion was prepared by dissolving 28 grams of gelatin and 13.2 grams of benzotriazole in 300 ml of water. The resulting solution was agitated at 40° C. A solution of 17 grams of silver nitrate in 100 ml of water was added to the solution over a period of 2 minutes.

The resulting silver benzotriazole emulsion was adjusted to such pH that an excess salt precipitated, and the excess salt was filtered off. The emulsion was then adjusted to pH 6.30, obtaining a silver benzotriazole emulsion in a yield of 400 grams.

Organic silver salt (2)

In 1000 ml of an aqueous solution of 0.1% sodium hydroxide and 200 ml of ethanol were dissolved 20 grams of gelatin and 5.9 grams of 4-acetylaminophenyl propiolic acid. The solution was agitated at 40° C. A solution of 4.5 grams of silver nitrate in 200 ml of water was added to the solution over a period of 5 minutes. The dispersion was adjusted to such pH that an excess salt precipitated, and the excess salt was filtered off. The dispersion was then adjusted to pH 6.3, obtaining a dispersion of organic silver salt (2) in a yield of 300 grams.

Next, a dispersion of a dye-providing substance in gelatin was prepared as follows.

Preparation of Gelatin Dispersion of Dye-Providing Substance

Five (5) grams of yellow dye-providing substance (A), 0.2 grams of auxiliary developing agent (D), and 0.2 grams of an antifoggant (E), all having the formulae shown below, were dissolved together with 0.5 grams of succinic acid-2-ethylhexyl ester sodium sulfonate surface-active agent and 10 grams of triisoonyl phosphate in 30 ml of ethyl acetate by heating at about 60° C., obtaining a homogeneous solution. The solution was mixed with 100 grams of a 10 wt % lime-treated gelatin solution by agitation, and the mixture was dispersed with a homogenizer for 10 minutes at 10,000 rpm. This dispersion is called yellow dye-providing substance dispersion.

A magenta dye-providing substance dispersion was prepared by the same procedure as above except that a magenta dye-providing substance (B) was used as the dye-providing substance and 7.5 grams of tricresyl phosphate was used as the high boiling solvent.

A cyan dye-providing substance dispersion was prepared by the same procedure as the yellow dye-providing substance dispersion except that a cyan dye-providing substance (C) was used.

Dye-Providing substance (A)

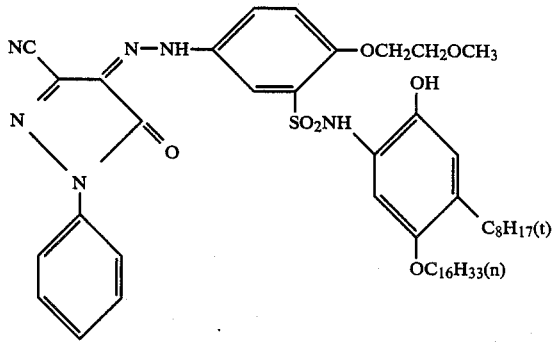

Dye-Providing substance (B)

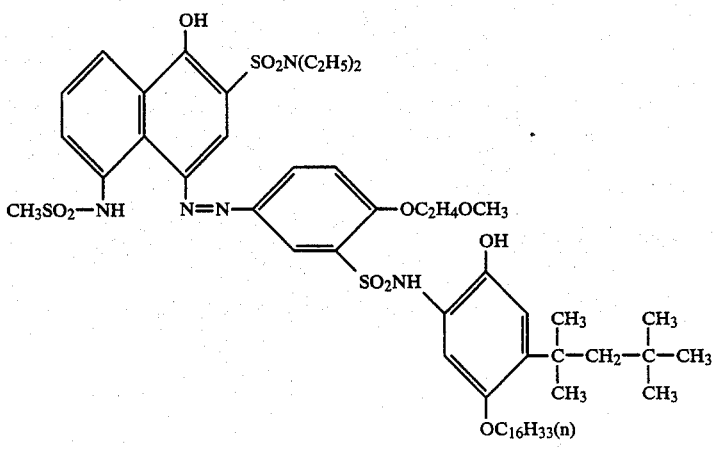

Dye-Providing substance (C)

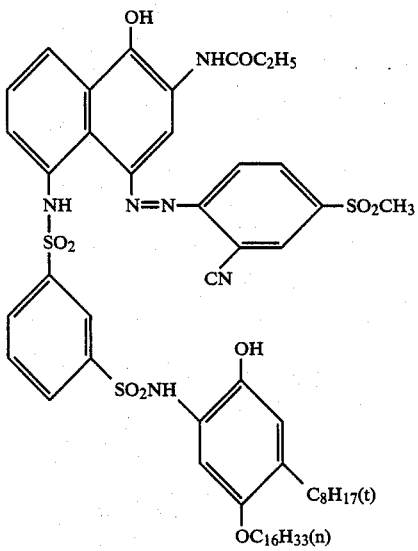

Auxiliary developing agent (D)

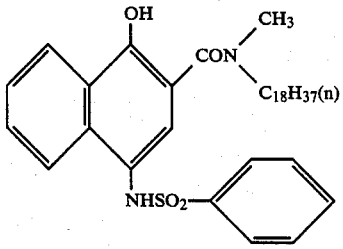

Antifoggant (E)

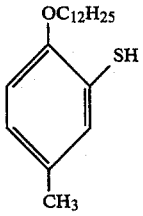

Using these preparations, a color photosensitive material No. 101 of multi-layer structure was prepared as shown in the following formulation:

FORMULATION

Sixth layer
gelatin (coating weight 800 mg/m$^2$)
hardener*6 (coating weight 100 mg/m$^2$)
silica*5 (coating weight 100 mg/m$^2$)
Zinc hydroxide*7 (coating weight 300 mg/m$^2$)
Fifth layer: Blue-sensitive emulsion layer
silver iodobromide emulsion (iodine 5 mol %, coating weight 400 mg/m$^2$ of Ag)
dimethyl sulfamide (coating weight 180 mg/m$^2$)
organic silver salt (2) (coating weight 100 mg/m$^2$ of Ag)
yellow dye-providing substance (A) (coating weight 400 mg/m$^2$)
gelatin (coating weight 1000 mg/m$^2$)
auxiliary developing agent (D) (coating weight 16 mg/m$^2$)
high-boiling solvent*4 (coating weight 800 mg/m$^2$)
surface-active agent*2 (coating weight 100 mg/m$^2$)
antifoggant (E) (coating weight 16 mg/m$^2$)
Fourth layer: Intermediate layer
gelatin (coating weight 1000 mg/m$^2$)
zinc hydroxide*3 (coating weight 300 mg/m$^2$)
Third layer: Green-sensitive emulsion layer
silver chlorobromide emulsion (bromine 80 mol %, coating weight 300 mg/m$^2$ of Ag)
dimethyl sulfamide (coating weight 180 mg/m$^2$)
organic silver salt (2) (coating) weight 100 mg/m$^2$ of Ag)
magenta dye-providing substance (B) (coating weight) 400 mg/m$^2$)
gelatin (coating weight 1000 mg/m$^2$)
auxiliary developing agent (D) (coating weight 16 mg/m$^2$)
high-boiling solvent*1 (coating weight 600 mg/m$^2$)
surface-active agent*2 (coating weight 100 mg/m$^2$)
antifoggant (E) (coating weight 16 mg/m$^2$)
Second layer: Intermediate layer -continued gelatin (coating weight 800 mg/m$^2$)
zinc hydroxide*7 (coating weight 300 mg/m$^2$)
First layer: Red-sensitive emulsion layer
silver chlorobromide emulsion (bromine 80 mol %, coating weight 300 mg/m$^2$ of Ag)
benzene sulfonamide (coating weight 180 mg/m$^2$)
organic silver salt (1) (coating weight 100 mg/m$^2$ of Ag)
sensitizing dye*3 (coating weight $8 \times 10^{-7}$ mol/m$^2$)
cyan dye-providing substance (C) (coating weight 300 mg/m$^2$)
gelatin (coating weight 1000 mg/m$^2$)
auxiliary developing agent (D) (coating weight 12 mg/m$^2$)
high-boiling solvent*4 (coating weight 450 mg/m$^2$)
surface-active agent*2 (coating weight 100 mg/m$^2$)
antifoggant (E) (coating weight 12 mg/m$^2$)

Support
*1tricresyl phosphate

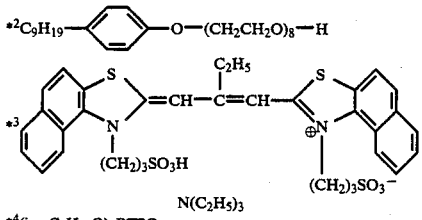

*4(iso-$C_9H_{19}O)_3P{=}O$
*5size 4 μm
*61,2-bis(vinylsulfonylacetamide)ethane

*7size 0.2 μm

Sample No. 102 having the same structure as Sample No. 101 was prepared except that 8 mol % based on the zinc hydroxide of zinc sulfate was added to each of the second and fourth layers of Sample No. 101.

Next, the preparation of a dye-fixing material will be described.

Preparation of Dye-Fixing Material

In 1300 ml of water were dissolved 63 grams of gelatin, 130 grams of a polymer mordant having the structure defined below, and 80 grams of quanidine picolinate. The solution was uniformly spread onto a polyethylene-laminated paper substrate, thereby forming a mordant layer having a uniform wet thickness of 45 μm.

Polymer mordant

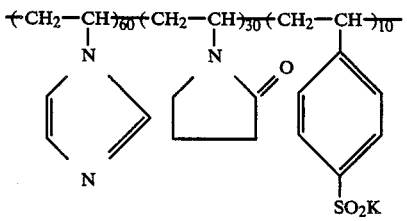

Separately, 35 grams of gelatin and 1.05 grams of 1,2-bis(vinylsulfonylacetamide)ethane were dissolved in 800 ml of water. The substrate was further coated with this solution to a wet film thickness of 17 μm. After drying, there was obtained a dye-fixing material D-1.

Each of the multilayered color photosensitive materials was exposed for one second at 2000 lux under a tungsten lamp through three color separation filters B, G, and R having a continuously varying density.

Water was applied by means of a wire bar in an amount of 15 ml per square meter to the emulsion surface of the thus exposed photosensitive material, which was superimposed on the dye-fixing material D-1 such that their effective surfaces faced one another. After heating for 25 seconds through heat rollers at such a temperature such that the temperature of the wet film reached 90° C., the dye-fixing material was peeled from the photosensitive material. The dye-fixing material then bore thereon clear images of yellow (Y), magenta (M), and cyan (C) corresponding to the three color separation filters B, G, and R. The maximum density (Dmax) and minimum density (Dmin) of the respective color images were measured by means of a Macbeth (RD-519) reflection densitometer. The results are shown in Table 1.

An aging test was performed by shelf storing the photosensitive materials for one week at a temperature of 40° C. and a relative humidity (RH) of 80% and then processing them in the same manner as above. The results are also shown in Table 1.

TABLE 1

| Photosensitive | Yellow | | Magenta | | Cyan | |
|---|---|---|---|---|---|---|
| Material No. | Dmin | Dmax | Dmin | Dmax | Dmin | Dmax |
| Immediately after preparation | | | | | | |
| 101 (comparison) | 0.14 | 1.99 | 0.16 | 2.13 | 0.16 | 2.35 |
| 102 (invention) | 0.13 | 1.98 | 0.14 | 2.11 | 0.14 | 2.30 |
| After 1-week aging at 40° C., RH 80% | | | | | | |
| 101 (comparison) | 0.19 | 2.02 | 0.22 | 2.15 | 0.24 | 2.38 |
| 102 (invention) | 0.15 | 2.00 | 0.16 | 2.14 | 0.17 | 2.35 |

As evident from the data in Table 1, the addition of a water-soluble salt, zinc sulfate improves the shelf stability of the photosensitive material according to the present invention.

EXAMPLE 2

Preparation of Silver Benzotriazole Emulsion Containing Photosensitive Silver Bromide A silver benzotriazole emulsion was prepared by dissolving 10 grams of gelatin and 6.5 grams of benzotriazole in 1000 ml of water. The resulting solution was agitated at 50° C. A solution of 8.5 grams of silver nitrate in 100 ml of water was added to the solution over a period of 2 minutes.

A solution of 1.2 grams of potassium bromide in 50 ml of water was then added over a period of 2 minutes. The resulting silver benzotriazole emulsion was adjusted to such pH that an excess salt precipitated, and the excess salt was filtered off. The emulsion was then adjusted to pH 6.0, obtaining a silver benzotriazole emulsion in a yield of 200 grams.

Preparation of Gelatin Dispersion of Dye-Providing Substance

Ten (10) grams of a dye-providing material having the formula:

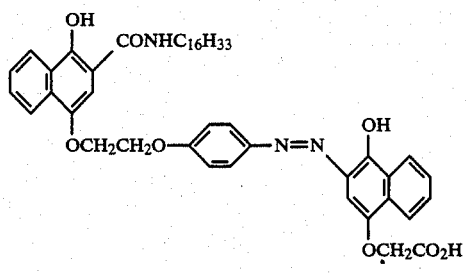

was dissolved together with 0.5 grams of succinic acid-2-ethylhexyl ester sodium sulfonate surface-active agent and 4 grams of tricresyl phosphate (TCP) in 20 ml of cyclohexanone by heating at about 60°, obtaining a homogeneous solution. The solution was mixed with 100 grams of a 10 wt % lime-treated gelatin solution by agitation, and the mixture was dispersed with a homogenizer for 10 minutes at 10,000 rpm.

Preparation of Photosensitive Coating Composition

A photosensitive coating composition was prepared from the following formulation.

| | | |
|---|---|---|
| (a) | Silver benzotriazole emulsion containing photosensitive silver bromide | 10 g |
| (b) | Dye-providing substance dispersion | 3.5 g |
| (c) | Gelatin (10% aqueous solution) | 5 g |
| (d) | 0.2 g of 2,6-dichloro-4-aminophenol in 2 ml of methanol | |
| (e) | Aqueous solution of 10% compound having the formula: 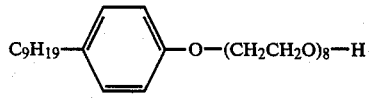 | 1 ml |
| (f) | Calcium carbonate (10% aqueous dispersion) | 4.0 g |

Components (a) to (f) were mixed and dissolved by heating. The resulting coating solution was applied to a polyethylene terephthalate base film of 180 μm thick to a wet thickness of 30 μm.

Further, the following composition was coated thereon as a protective coating.

| | |
|---|---|
| (g) 10% gelatin aqueous solution | 30 ml |
| (h) water | 60 ml |
| (i) Aqueous solution of 2 wt % 1,2-bis-(vinylsulfonylacetamide)ethane | 5 ml |

Components g to (i) were mixed. The protective composition was coated onto the photosensitive coating to a wet thickness of 30 μm and then dried, obtaining a photosensitive material Sample No. 201.

Sample No. 202 having the same composition as Sample No. 201 was prepared except that 40 mg of calcium chloride was added to the photosensitive coating composition of Sample No. 201.

Each of the photosensitive materials thus prepared was imagewise exposed for ten seconds at 2000 lux under a tungsten lamp.

Dye-fixing material D-2 was prepared by the same procedure as described for dye-fixing material D-1 except that the guanidine picolinate was replaced by 60 grams of guanidine oxate.

The exposed photosensitive materials were processed in combination with dye-fixing material D-2 by the same procedure as in Example 1, obtaining the following results.

| Sample No. | 201 (Comparison) | 202 (Invention) |
|---|---|---|
| Maximum density | 1.56 | 1.54 |
| Minimum density | 0.15 | 0.14 |

An aging test was performed by shelf storing the photosensitive materials for 7 days at 40° C. and a relative humidity (RH) of 80% and processing them in the same manner as described above. The results are shown below.

| Sample No. | 201 (Comparison) | 202 (Invention) |
|---|---|---|
| Maximum density | 1.66 | 1.59 |
| Minimum density | 0.26 | 0.18 |

It is evident that the photosensitive material of the present invention has better shelf stability.

EXAMPLE 3

Preparation of Gelatin Dispersion of Dye-Providing Substance

A solution of 5 grams of a dye-releasing substance susceptible to reduction having the following formula, 4 grams of an electron-donative substance having the following formula, 0.5 grams of succinic acid-2-ethylhexyl ester sodium sulfonate, and 10 grams of tricresyl phosphate (TCP) in 20 ml of cyclohexanone was prepared by heating at about 60° C. The solution was mixed with 100 grams of a 10 wt % gelatin solution by agitation, and the mixture was dispersed with a homogenizer for 10 minutes at 10,000 rpm.

Reducable dye-releasing substance

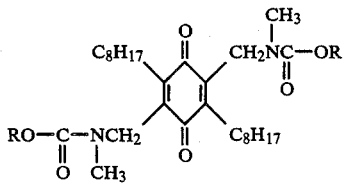

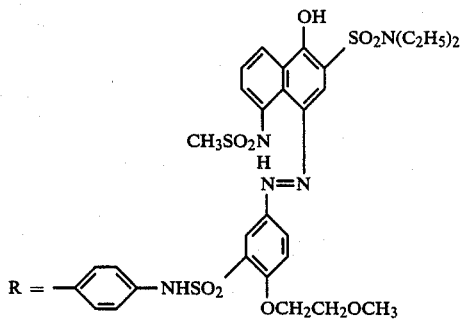

Electron-dontative substance

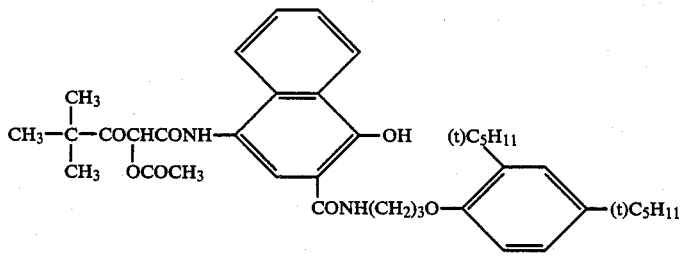

Preparation of Photosensitive Coating Composition

A photosensitive coating composition was prepared from the following formulation.

Photosensitive coating composition

| | | |
|---|---|---|
| (a) | Silver benzotriazole emulsion containing photosensitive silver bromide (as in Example 2) | 10 g |
| (b) | Dye-providing substance dispersion | 3.5 g |
| (c) | Aqueous solution of 5% compound having the formula: | 1.5 ml |

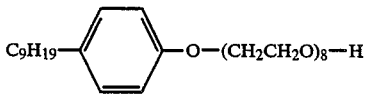

| | | |
|---|---|---|
| (d) | Zinc hydroxide (20% aqueous dispersion) | 3.0 g |

Components (a) to (d) were mixed and dissolved by heating. The resulting coating solution was applied to a polyethylene terephthalate base film to a wet thickness of 30 μm and dried.

Further, the following composition was coated thereon as a protective coating.

Protective composition

| | |
|---|---|
| (g) 10% gelatin aqueous solution | 30 g |
| (h) water | 70 ml |
| (i) Aqueous solution of 2 wt % 1,2-bis-(vinylsulfonylacetamide)ethane | 5 ml |

Components (g) to (i) were mixed. The protective composition was coated onto the photosensitive coating to a wet thickness of 30 μm and then dried, obtaining a photo-sensitive material Sample No. 301.

Sample No. 302 having the same composition as Sample No. 301 was prepared except that 140 mg of zinc sulfate heptahydrate was added to the photosensitive coating composition of Sample No. 301.

Each of the photosensitive materials thus prepared was imagewise exposed for ten seconds at 2000 lux under a tungsten lamp. The exposed photosensitive material was processed in combination with dye-fixing material D-1 by the same procedure as in Example 1, obtaining the following results.

| Sample No. | 301 (Comparison) | 302 (Invention) |
|---|---|---|
| Maximum density | 2.04 | 2.02 |
| Minimum density | 0.24 | 0.22 |

An aging test was performed by shelf storing the photosensitive materials for 7 days at 40° C. and a relative humidity (RH) of 80% and processing them in the same manner as described above. The results are shown below.

| Sample No. | 301 (Comparison) | 302 (Invention) |
|---|---|---|
| Maximum density | 2.00 | 2.01 |
| Minimum density | 0.36 | 0.26 |

It is evident that the photosensitive material of the present invention has better shelf stability.

EXAMPLE 4

Preparation of Gelatin Dispersion of Dye-Providing Substance

Dispersions of dye-providing substances in gelatin were prepared as follows. The yellow, magenta, and cyan dye-providing substances (A), (B), and (C) used are the same as in Example 1.

A homogeneous solution of 5 grams of yellow dye-providing substance (A), 0.5 grams of succinic acid-2-ethylhexyl ester sodium sulfonate surface-active agent, and 10 grams of triisononyl phosphate in 30 ml of ethyl acetate was prepared by heating at about 60° C. The solution was mixed with 100 grams of a 10 wt % lime-treated gelatin solution by agitation, and the mixture was dispersed with a homogenizer for 10 minutes at 10,000 rpm. This dispersion is called yellow dye-providing substance dispersion.

A magenta dye-providing substance dispersion was prepared by the same procedure as above except that magenta dye-providing substance (B) was used as the dye-providing substance and 7.5 grams of tricresyl phosphate was used as the high boiling solvent.

A cyan dye-providing substance dispersion was prepared by the same procedure as the yellow dye-providing substance dispersion except that cyan dye-providing substance (C) was used.

The silver halide emulsions and silver benzotriazole emulsions used in the first, third, and fifth layers were prepared by the same procedures as in Example 1.

Using these preparations, a color photosensitive material Sample No. 401 of multi-layer structure was prepared as shown in the following formulation:

FORMULATION

| |
|---|
| Sixth layer |
| gelatin (coating weight 800 mg/m$^2$) |
| hardener*5 (coating weight 16 mg/m$^2$) |
| Basic zinc carbonate (coating weight 500 mg/m$^2$) |
| Fifth layer: Blue-sensitive emulsion layer |
| silver iodobromide emulsion (iodine 5 mol %, coating weight 400 mg/m$^2$ of Ag) |

-continued silver benzotriazole emulsion (coating weight 100 mg/m$^2$ of Ag)
hardener*5 (coating weight 16 mg/m$^2$)
yellow dye-providing substance (A) (coating weight 400 mg/m$^2$)
gelatin (coating weight 1000 mg/m$^2$)
high-boiling solvent*4 (coating weight 800 mg/m$^2$)
surface-active agent*2 (coating weight 100 mg/m$^2$)

Fourth layer: Intermediate layer gelatin (coating weight 900 mg/m$^2$)
hardener*5 (coating weight 18 mg/m$^2$)
basic zinc carbonate (coating weight 400 mg/m$^2$)

Third layer: Green-sensitive emulsion layer silver chlorobromide emulsion (bromine 80 mol %, coating weight 300 mg/m$^2$ of Ag)
silver benzotriazole emulsion (coating weight 100 mg/m$^2$ of Ag)
hardener*5 (coating weight 18 mg/m$^2$)
magenta dye-providing substance (B) (coating weight 400 mg/m$^2$)
gelatin (coating weight 1000 mg/m$^2$)
high-boiling solvent*1 (coating weight 600 mg/m$^2$)
surface-active agent*2 (coating weight 100 mg/m$^2$)

Second layer: Intermediate layer gelatin (coating weight 800 mg/m$^2$)
hardener*5 (coating weight 16 mg/m$^2$)
basic zinc carbonate (coating weight 450 mg/m$^2$)

First layer: Red-sensitive emulsion layer silver chlorobromide emulsion (bromine 80 mol %, coating weight 300 mg/m$^2$ of Ag)
silver benzotriazole emulsion (coating weight 100 mg/m$^2$ of Ag)
sensitizing dye*3 (coating weight $8 \times 10^{-7}$ mol/m$^2$)
cyan dye-providing substance (C) (coating weight 300 mg/m$^2$)
gelatin (coating weight 1000 mg/m$^2$)
high-boiling solvent*4 (coating weight 450 mg/m$^2$)
surface-active agent*2 (coating weight 100 mg/m$^2$)
hardener*5 (coating weight 16 mg/m$^2$)
Support

*1tricresyl phosphate

*2 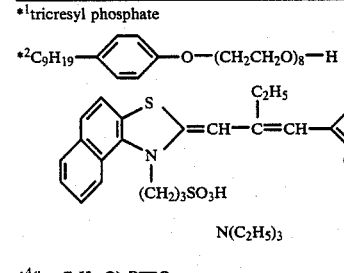

*4(iso-$C_9H_{19}O)_3P{=}O$
*5 1,2-bis(vinylsulfonylacetamide)ethane

Sample No. 402 having the same structure as Sample No. 401 was prepared except that 8 mol % based on the basic zinc carbonate of zinc sulfate was added to each of the second and fourth layers of Sample No. 401.

The preparation of a dye-fixing material D-3 will be described.

In 175 ml of water was dissolved 10 grams of poly(-methyl acrylate-co-N,N,N-trimethyl-N-vinylbenzylammonium chloride) having a molar ratio of methyl acrylate to vinylbenzyl ammonium chloride of 1:1. The solution was homogeneously mixed with 100 grams of 10 wt % lime-treated gelatin. The resulting mixture was combined with 25 ml of an aqueous solution of 4% 2,4-dichloro-6-hydroxy-1,3,5-triazine and uniformly spread onto a paper substrate laminated with polethylene having titanium dioxide dispersed therein, thereby forming a dye-fixing layer having a uniform wet thickness of 90 μm.

Separately, 10 grams of guanidine picolinate, 20 grams of 10% gelatin, and 4.8 ml of aqueous solution of 1% succinic acid-2-ethylhexyl ester sodium sulfonate were dissolved in 18 ml of water by agitation. The solution was coated onto the substrate to a wet film thickness of 30 ? m. After drying, there was obtained dye-fixing material D-3 having a mordant layer.

Each of the following multilayered color photosensitive materials was exposed for one second at 2000 lux under a tungsten lamp through three color separation filters B, G, and R having a continuously varying density.

Water was applied by means of a wire bar in an amount of 20 ml per square meter to the emulsion surface of the thus exposed photosensitive material, which was superimposed on the dye-fixing material D-3 such that their effective surfaces faced one another. Thereafter, the same procedure as in Example 1 was repeated to find that the results of photosensitive material Sample Nos. 401 (comparison) and 402 (invention) were substantially equivalent to those of Example 1.

It is thus evident that the addition of a water-soluble salt, zinc sulfate improve the shelf stability of the photosensitive material according to the present invention.

The foregoing examples demonstrate the improved results of the present invention.

We claim:

1. A process for forming an image, comprising subjecting a silver halide photosensitive material, which comprises a substantially water-insoluble basic metal compound and a water-soluble salt of the same metal ion as said basic metal compound, and said basic metal is a transition metal or an alkaline earth metal, to imagewise exposure and then to a development treatment, wherein the developing treatment is carried out in the presence of water and a compound capable of water-mediated complexing reaction with the metal of said substantially water-insoluble basic metal compound.

2. The image forming process of claim 1 wherein said substantially water-insoluble basic metal compound is selected from the group consisting of carbonate salts, phosphate salts, silicate salts, borate salts, aluminate salts, hydroxides, oxides, and double salts thereof, provided that they have a solubility in water at 20° C. of 0.5 or less as expressed in grams of the compound dissolved in 100 grams of water.

3. The image forming process of claim 1 wherein said water-soluble salt is selected from the group consisting of salts of hydrochloric acid, sulfuric acid, nitric acid, carboxylic acid, and sulfonic acid, provided that they have a solubility in water at 20° C. of at least ten times that of said substantially water-insoluble basic metal compound.

4. The image forming process of claim 1 wherein said photosensitive material is comprised of a heat-developable material containing a dye-providing substance capable of yielding a diffusible dye, the developing treatment involves development and diffusion transfer of the diffusible dye, and the development and/or diffusion transfer is assisted by heating.

5. The image forming process of claim 1 wherein said substantially water-insoluble basic metal compound is present in an amount of up to 50% by weight based on the weight of a coating film containing the same compound.

6. The image forming process of claim 1 wherein the amount of said water-soluble salt present is up to an equimolar amount to the substantially water-insoluble basic metal compound.

* * * * *